United States Patent [19]

Candler

[11] 4,245,949

[45] Jan. 20, 1981

[54] ARCHIMEDEAN SCREW PUMPS

[75] Inventor: Nigel D. Q. Candler, Hungerford, England

[73] Assignee: Sigmund Pulsometer Pumps Limited, Reading, England

[21] Appl. No.: 961,017

[22] Filed: Nov. 15, 1978

[30] Foreign Application Priority Data

Nov. 18, 1977 [GB] United Kingdom ..... 48137/77

[51] Int. Cl.[3] ..... F04D 3/02

[52] U.S. Cl. ..... 415/73

[58] Field of Search ..... 415/72, 73, 74, 75; 416/176 R, 177; 198/662, 676

[56] References Cited

U.S. PATENT DOCUMENTS

| | | | |
|---|---|---|---|
| 1,150,408 | 8/1915 | Wilson | 416/177 |
| 1,196,696 | 8/1916 | Jones | 416/177 |

FOREIGN PATENT DOCUMENTS

| | | | |
|---|---|---|---|
| 1475321 | 6/1977 | United Kingdom | 415/73 |

*Primary Examiner*—Leonard E. Smith

*Attorney, Agent, or Firm*—Cushman, Darby & Cushman

[57] ABSTRACT

An improved form of archimedean screw pump is disclosed comprising a pump cylinder having an internal helicoidal vane portion affixed to the said pump cylinder by its circumferential helical edge and a partial core portion affixed to and extending from the said vane portion, the length of a section of said partial core portion on a plane through the axis of the pump cylinder, being greater than or equal to the longitudinal distance, in the said plane, between adjacent longitudinally spaced vane portions. The provision of a ribbon core substantially avoids the "choking" problems of known pumps of this type and the particular form of ribbon core enables the throughput of the pump further to be improved.

12 Claims, 2 Drawing Figures

(a) (b) (c) (d)

ARCHIMEDEAN SCREW PUMPS

Figure 1:
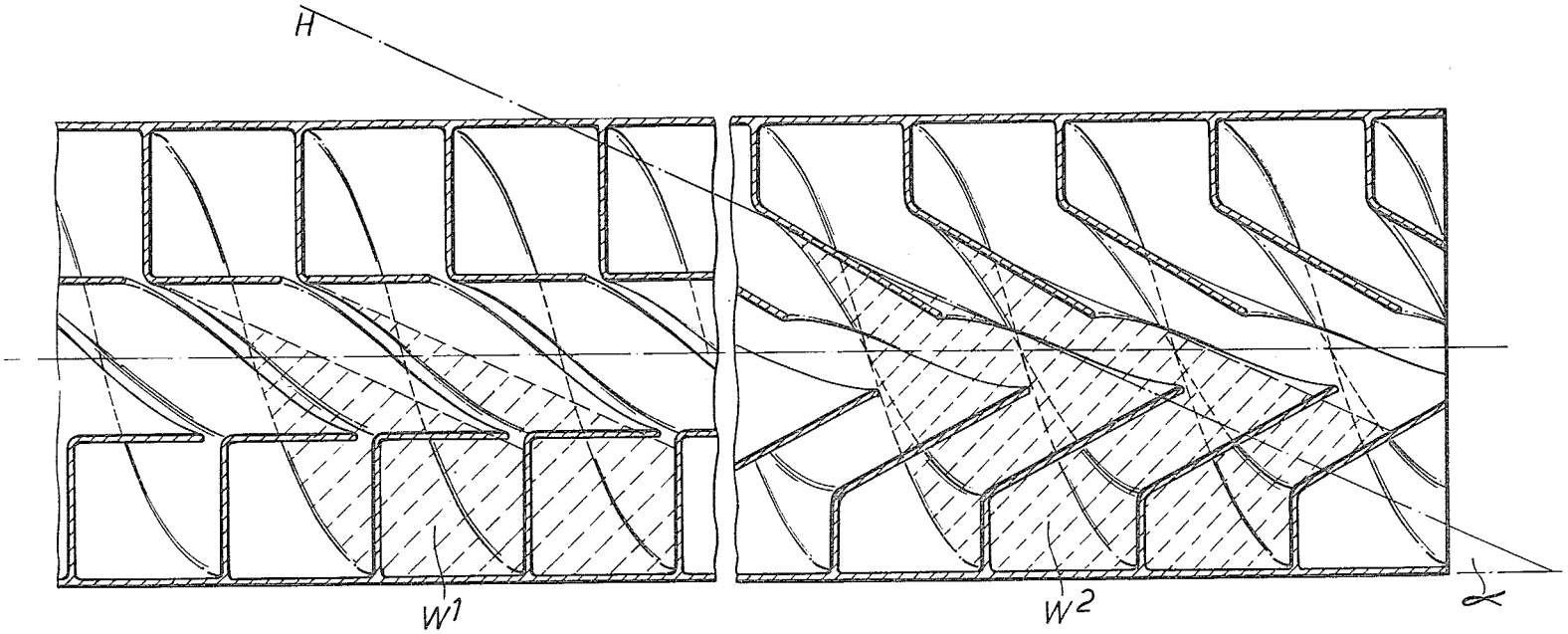

This invention relates to a modified form of archimedean screw pump, in particular archimedean screw pumps comprising a cylinder having one or more internal helicoidal vanes. Chandler, U.S. Pat. No. 4,170,436, issued Oct. 9, 1979 relates to such pumps and a method by which they may be made.

In a preferred form of pump according to the invention of Chandler, U.S. Pat. No. 4,170,436, the helicoidal vanes of the pump are provided with a helical flange which forms part of a helical partial or ribbon core coaxial with the pump cylinder.

As is stated in the specification of that patent, fully cored archimedean screw pumps of the closed type, in situations where the lower opening of the pump is completely immersed in the material to be raised, may be prone to intermittent interruptions of output, or "choking", even while the pump is still rotating and the lower end immersed. It has been found that the use of a ribbon type core substantially avoids this problem.

According to the present invention an archimedean screw pump comprises a cylinder having an internal helicoidal vane portion and a partial core portion extending from the vane portion, the length of the partial core portion being greater than or equal to the longitudinal distance between adjacent vane portions.

The pump is preferably a three start screw, i.e. one which has three vanes and associated core portions, although pumps embodying the invention and having more or less vanes may be effective in certain circumstances.

In order to retain the advantages of the partial or ribbon core a clearance must be left between the free end of the partial core and the surface of the next adjacent vane and this may be achieved in various ways.

The helicoidal vane portions may be, for example, linear or arcuate, and substantially normal or angled, to the cylinder wall. The partial core portions may extend from the free edges of the vane portions, i.e. from the edges not attached to the cylinder wall, and may be, for example, substantially helical and coaxial with the cylinder for the most part of their length but with their free edges angled or turned inwards towards the cylinder axis; linear and angled from the vane portion towards the cylinder axis; or arcuate over its whole length and again turning inwardly towards the cylinder axis. Each of the partial core portions may be provided with a further helical flange portion extending longitudinally from the free edge of the partial core portion which flange may be substantially helical and coaxial with the cylinder axis. Any and all combinations of these exemplified vane and core portions are envisaged as offering advantages for specific applications. The core structure here referred to is termed "partial" because it extends insufficiently radially inwardly to merge with axle structure conventionally, but not here provided along the cylinder axis.

In all of the above forms, the relationships between the vanes and cylinder wall are described for convenience with reference to a section through the cylinder axis of the pump. Thus the terms "linear", "angled", "arcuate" etc. relate to the edge appearance of a vane or core portion in such section.

The pumps according to the present invention are preferably made by the modular construction disclosed and claimed in the aforementioned earlier U.S. patent of Chandler in that they are constructed from a plurality of like modules each having a first portion constituting part of the cylinder wall, a second portion constituting part of the helicoidal vane portion and a third portion constituting part of the partial core depending from the inner helical edge of the second portion. These modules constitute a further aspect of the invention. The modules when assembled together form a screw pump having a screw pump cylinder made out of the said first portions, one or more helicoidal vane portions made out of the second portions of the modules and each helicoidal vane portion having the novel partial core portion extending from it. The modules can be assembled to form a pump of any desired length, or alternatively the pump may be built up from several discrete compatible cylindrical units, each of these cylindrical units having been assembled from the modules.

Thus it is possible to build up a screw pump of any desired length using the appropriate number of modules or number of cylindrical units. The modules themselves or their constituent portions may be of simple form with all the surfaces which will be in contact with the material being pumped readily accessible so that they can have a smooth surface finish and if desired be subjected to surface treatment before the modules are assembled together. This manner of construction is particularly suitable for manufacture using a polymeric plastics material (with or without glass fibre or other reinforcement), the modules being formed in or on moulds or patterns.

The substantially coreless form of the invention makes for ease of cleaning and maintenance.

The pump cylinder may be supported for rotation on rolling element bearings, pericyclic or epicyclic rollers, by hydrostatic bearing pads or on any other suitable means permitting rotation. The support means may act upon the pump cylinder or upon, within or against specially prepared tracks which may be formed on or attached to the outer surface of the pump cylinder or to fixed foundations.

The driving torque may be supplied by means which bear upon the outer surface of the pump cylinder or on the said tracks (if used) and may be applied via one or more of the supporting rollers (if used). The rollers may be provided with a tyre with suitable friction characteristics or with a suitably toothed surface so as to ensure reliable rotation of the cylinder. In different operating circumstances other forms of drive independent of the support means such as toothed belt, toothed wheel and chain or linear electric motor may be used to rotate the cylinder.

The pump may be provided with one or more external peripheral collars having radial flanges which can co-operate with one or more thrust bearings. The co-operation between the thrust bearings and the flanges acts to prevent the cylinder from sliding down relative to the means which support it for rotation. The driving torque may be imparted to the cylinder through such a thrust bearing.

In operation the efficiency of the pump may be reduced by a flow of liquid matter over the lip of the cylinder at its upper end which trickles down the outside wall of the cylinder. To prevent this, suitable sealing means may be provided.

Further details of construction and operation of screw pumps of the type to which the present pumps belong is given in the aforementioned earlier U.S. patent of Chandler.

Figure 2:
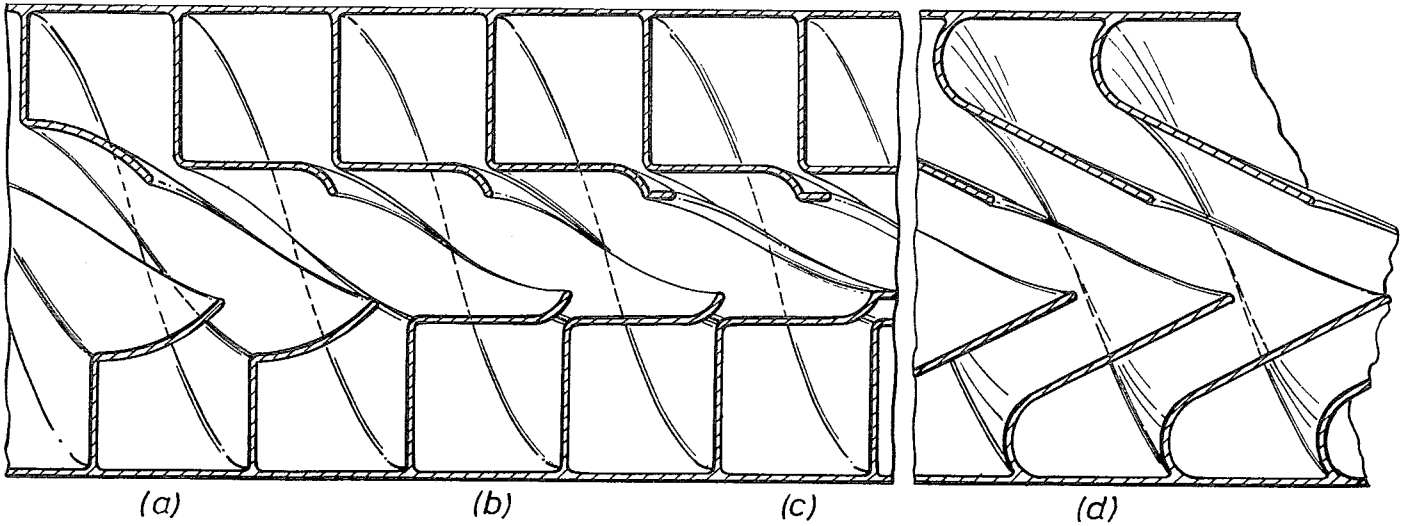

The invention may be performed in various ways and a number of embodiments will now be described, by way of example with reference to the accompanying drawings in which:

FIG. 1 is a composite section showing a Prior Art pump to the left and a pump embodying the invention on the right, and FIG. 2 is a section through a composite pump showing different vane and core portions according to the invention.

Referring to the drawings, a line H has been superimposed on FIG. 1 to indicate the horizontal. The figure thus shows the pump disposed at a shallow angle alpha to the horizontal.

The left hand side of the drawing shows a pump having vanes disposed substantially normal to the cylinder wall and having a helical ribbon core coaxial with the pump cylinder as described in the aforementioned earlier U.S. patent of Chandler. On the right hand side of the sketch the pump again has vane portions substantially normal to the cylinder wall but the partial core portions are angled inwardly from the vane portions towards the pump axis. The length of the partial core portions in a longitudinal direction is greater than the distance between adjacent vane portions. As will be seen by comparisons of the shaded areas, W1 and W2, the volume of fluid being pumped held between a vane and core portion and an adjacent vane and core portion is greater with the novel construction shown in the right hand side of the sketch thus evidencing an improvement in the throughput capacity of the pump.

Referring now to FIG. 2, at (a), there is shown a construction of vane and partial core having a vane portion extending substantially normal to the cylinder wall with an arcuate partial core portion extending from its free edge, with the curvature being towards the pump axis. At (b) there is shown a similar vane portion but this time the partial core being helical and substantially coaxial with the cylinder axis for the most part of its length, but with its free edge angled or turned inwards towards the cylinder axis. At (c) there is shown a modification on the vane and core portions of (b) in that an additional substantially helical flange substantially coaxial with the cylinder axis extends from the free edge of the partial core portion.

At (d) there is shown a construction wherein the vane portion is arcuate, the partial core portion extending tangentially from the vane portion towards the axis of the cylinder.

In all cases, the partial core portions will extend from the vane portions longitudinally upstream in use. The further flange extending from the free edge of the partial core portion of construction (c) may be applied to other partial core constructions embodying the present invention.

The content and disclosure of the U.S. Patent of Candler, U.S. Pat. No. 4,170,436, issued Oct. 9, 1979 is incorporated herein by reference.

What I claim as my invention and desire to secure by Letters Patent is:

1. A module for forming, together with a number of like modules, an archimedean screw pump having a cylinder wall, an internal helicoidal vane affixed to and extending from said wall and a partial core portion affixed to and extending from said vane, said module comprising a first helical portion forming part of the wall of a hollow cylinder, a second substantially helicoidal portion projecting inwardly from said first portion, and a third portion extending from said second portion, the portions forming, on assembly of the modules to form said screw pump, said cylinder wall, said internal substantially helicoidal vane and said partial core, the length of said third portion being greater than or equal to the length of said first portion.

2. An archimedean screw pump comprising a pump cylinder having an internal helicoidal vane portion affixed to the said pump cylinder by its circumferential helical edge and a partial core portion affixed to and extending from the said vane portion, the length of a section of said partial core portion on a plane through the axis of the pump cylinder, being greater than or equal to the longitudinal distance, in the said plane, between adjacent longitudinally spaced vane portions.

3. A pump as claimed in claim 2 wherein a section through said helicoidal vane portion in said plane is linear.

4. A pump as claimed in claim 2 wherein a section through said helicoidal vane portion in said plane is arcuate.

5. A pump as claimed in any of claims 2 to 4 wherein a section through said helicoidal vane portion in said plane extends substantially normally from said pump cylinder.

6. A pump as claimed in any of claims 2 to 4 wherein a section through said helicoidal vane portion in said plane extends at an angle other than a right angle to said pump cylinder.

7. A pump as claimed in claim 2 wherein said partial core portion extends from the substantially helical free edge of said helicoidal vane portion remote from said circumferential helical edge.

8. A pump as claimed in claim 2 wherein said partial core portion is substantially helical and coaxial with said cylinder for the most part of the sectional length of said core portion, said partial core portion being angled or turned away from helical and coaxial adjacent the edge of said core portion remote from said vane portion.

9. A pump as claimed in claim 2 wherein a section through said partial core portion in said plane is substantially linear and angled from said vane portion towards the cylinder axis.

10. A pump as claimed in claim 2 wherein a section through said partial core portion in said plane is arcuate over its whole length.

11. A pump as claimed in claim 2 further provided with a substantially helical flange portion extending longitudinally from said free edge of the partial core portion remote from said cylinder.

12. A pump as claimed in claim 2 having a plurality of like ones of vanes and associated core portions.

* * * * *